US007030894B2

(12) United States Patent
Allen et al.

(10) Patent No.: US 7,030,894 B2
(45) Date of Patent: Apr. 18, 2006

(54) IMAGE DISPLAY SYSTEM AND METHOD

(75) Inventors: William J. Allen, Corvallis, OR (US); Mark E. Gorzynski, Corvallis, OR (US); P Guy Howard, Junction City, OR (US); Paul J. McClellan, Bend, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 714 days.

(21) Appl. No.: 10/213,555

(22) Filed: Aug. 7, 2002

(65) Prior Publication Data

US 2004/0028293 A1 Feb. 12, 2004

(51) Int. Cl.
*G09G 5/02* (2006.01)

(52) U.S. Cl. ..... 345/698; 382/299; 382/300; 348/755; 348/771

(58) Field of Classification Search ..... 345/32, 345/56, 204, 698, 699; 382/210, 299; 348/755, 348/771; 359/224, 291, 317, 495
See application file for complete search history.

(56) References Cited

U.S. PATENT DOCUMENTS

| | | | | |
|---|---|---|---|---|
| 4,662,746 | A | | 5/1987 | Hornbeck |
| 4,956,619 | A | | 9/1990 | Hornbeck |
| 5,061,049 | A | | 10/1991 | Hornbeck |
| 5,083,857 | A | | 1/1992 | Hornbeck |
| 5,386,253 | A | | 1/1995 | Fielding |
| 5,402,184 | A | | 3/1995 | O'Grady et al. |
| 5,490,009 | A | | 2/1996 | Venkateswar et al. |
| 5,530,482 | A | * | 6/1996 | Gove et al. ..... 348/441 |
| 5,689,283 | A | | 11/1997 | Shirochi |
| 5,742,274 | A | * | 4/1998 | Henry et al. ..... 345/698 |
| 5,757,355 | A | * | 5/1998 | Ogura et al. ..... 345/660 |
| 5,842,762 | A | | 12/1998 | Clarke |
| 5,897,191 | A | | 4/1999 | Clarke |
| 5,978,518 | A | | 11/1999 | Oliyide et al. |
| 6,025,951 | A | | 2/2000 | Sw art et al. |
| 6,104,375 | A | | 8/2000 | Lam |
| 6,141,039 | A | | 10/2000 | Poetsch |
| 6,184,969 | B1 | | 2/2001 | Fergason |
| 6,219,017 | B1 | | 4/2001 | Shimada et al. |
| 6,239,783 | B1 | | 5/2001 | Hill et al. |

(Continued)

FOREIGN PATENT DOCUMENTS

EP 1001306 A2 5/2000

OTHER PUBLICATIONS

T. Tokita et al., "P-108: FLC Resolution-Enhancing Device for Projection Displays", SID 02 Digest, 2002, pp. 638-641.
D. Chen, "Display Resolution Enhancement With Optical Scanners", Applied Optics, vol. 40, No. 5, Feb. 10, 2001, pp. 636-643.
A. Yasuda et al., "FLC Wobbling For High-Resolution Projectors", Journal of the SID 5/3, 1997, pp. 299-305.

*Primary Examiner*—Henry N. Tran

(57) ABSTRACT

A method of displaying an image includes receiving image data for the image, buffering the image data for the image, including creating a frame of the image, defining a first sub-frame and at least a second sub-frame for the frame of the image from the image data, the second sub-frame being spatially offset from the first sub-frame, and alternating between displaying the first sub-frame in a first position and displaying the second sub-frame in a second position spatially offset from the first position.

33 Claims, 7 Drawing Sheets

U.S. PATENT DOCUMENTS 6,313,888 B1 11/2001 Tabata
6,384,816 B1 5/2002 Tabata
6,393,145 B1 5/2002 Betrisey et al.
6,657,603 B1 12/2003 Demetrescu et al.
6,825,835 B1 * 11/2004 Sano et al. ..... 345/204
2003/0011614 A1 * 1/2003 Itoh et al. ..... 345/589
2003/0020809 A1 1/2003 Gibbon et al.
2003/0133060 A1 * 7/2003 Shimada ..... 349/113

* cited by examiner

62

(WITH TWO-POSITION PROCESSING)

60

(WITHOUT PROCESSING)

66

(WITH FOUR-POSITION PROCESSING)

64

(WITHOUT PROCESSING)

IMAGE DISPLAY SYSTEM AND METHOD

THE FIELD OF THE INVENTION

The present invention relates generally to imaging systems, and more particularly to a system and method of displaying an image.

BACKGROUND OF THE INVENTION

A conventional system or device for displaying an image, such as a display, projector, or other imaging system, produces a displayed image by addressing an array of individual picture elements or pixels arranged in horizontal rows and vertical columns. A resolution of the displayed image is defined as the number of horizontal rows and vertical columns of individual pixels forming the displayed image. The resolution of the displayed image is affected by a resolution of the display device itself as well as a resolution of the image data processed by the display device and used to produce the displayed image.

Typically, to increase a resolution of the displayed image, the resolution of the display device as well as the resolution of the image data used to produce the displayed image must be increased. Increasing a resolution of the display device, however, increases a cost and complexity of the display device. In addition, higher resolution image data may not be available and/or may be difficult to generate.

Accordingly, it is desired to increase a resolution of a displayed image without having to increase a resolution of a display device displaying the displayed image and/or with or without having to increase a resolution of image data used to produce the displayed image.

SUMMARY OF THE INVENTION

One aspect of the present invention provides a method of displaying an image. The method includes receiving image data for the image, buffering the image data for the image, including creating a frame of the image, defining a first sub-frame and at least a second sub-frame for the frame of the image from the image data, the second sub-frame being spatially offset from the first sub-frame, and alternating between displaying the first sub-frame in a first position and displaying the second sub-frame in a second position spatially offset from the first position.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
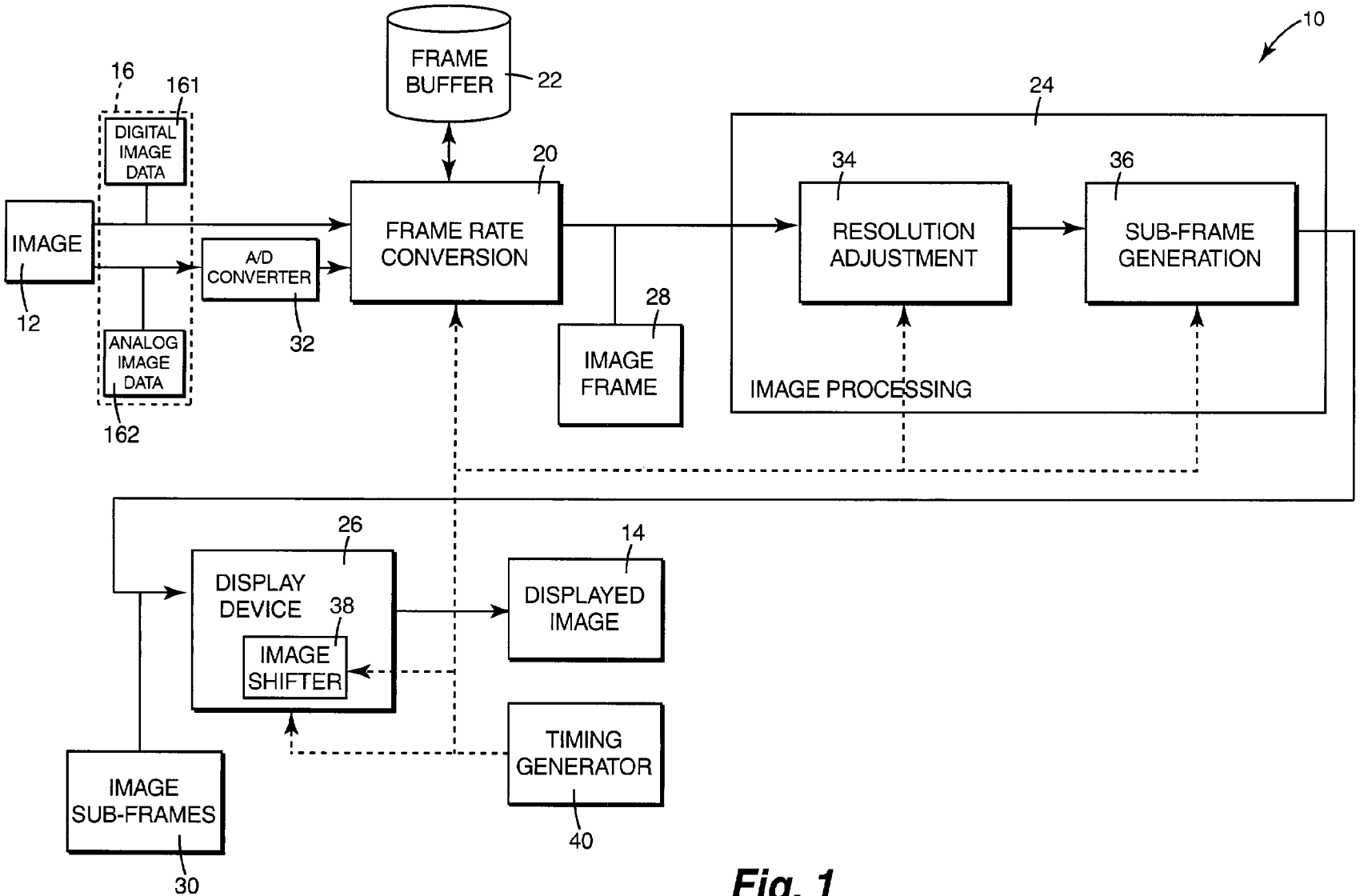
FIG. 1 is a block diagram illustrating one embodiment of an image display system.

FIG. 1 illustrates one embodiment of an image display system 10. Image display system 10 facilitates processing of an image 12 to create a displayed image 14. Image 12 is defined to include any pictorial, graphical, and/or textural characters, symbols, illustrations, and/or other representation of information. Image 12 is represented, for example, by image data 16. Image data 16 includes individual picture elements or pixels of image 12. While one image is illustrated and described as being processed by image display system 10, it is understood that a plurality or series of images may be processed and displayed by image display system 10.

In one embodiment, image display system 10 includes a frame rate conversion unit 20 and an image frame buffer 22, an image processing unit 24, and a display device 26. As described below, frame rate conversion unit 20 and image frame buffer 22 receive and buffer image data 16 for image 12 to create an image frame 28 for image 12. In addition, image processing unit 24 processes image frame 28 to define one or more image sub-frames 30 for image frame 28, and display device 26 temporally and spatially displays image sub-frames 30 to produce displayed image 14.

Image display system 10, including frame rate conversion unit 20 and/or image processing unit 24, includes hardware, software, firmware, or a combination of these. In one embodiment, one or more components of image display system 10, including frame rate conversion unit 20 and/or image processing unit 24, are included in a computer, computer server, or other microprocessor-based system capable of performing a sequence of logic operations. In addition, processing can be distributed throughout the system with individual portions being implemented in separate system components.

Image data 16 may include digital image data 161 or analog image data 162. To process analog image data 162, image display system 10 includes an analog-to-digital (A/D) converter 32. As such, A/D converter 32 converts analog image data 162 to digital form for subsequent processing. Thus, image display system 10 may receive and process digital image data 161 and/or analog image data 162 for image 12.

Frame rate conversion unit 20 receives image data 16 for image 12 and buffers or stores image data 16 in image frame buffer 22. More specifically, frame rate conversion unit 20 receives image data 16 representing individual lines or fields of image 12 and buffers image data 16 in image frame buffer 22 to create image frame 28 for image 12. Image frame buffer 22 buffers image data 16 by receiving and storing all of the image data for image frame 28 and frame rate conversion unit 20 creates image frame 28 by subsequently retrieving or extracting all of the image data for image frame 28 from image frame buffer 22. As such, image frame 28 is defined to include a plurality of individual lines or fields of image data 16 representing an entirety of image 12. Thus, image frame 28 includes a plurality of columns and a plurality of rows of individual pixels representing image 12.

Frame rate conversion unit 20 and image frame buffer 22 can receive and process image data 16 as progressive image data and/or interlaced image data. With progressive image data, frame rate conversion unit 20 and image frame buffer 22 receive and store sequential fields of image data 16 for image 12. Thus, frame rate conversion unit 20 creates image frame 28 by retrieving the sequential fields of image data 16 for image 12. With interlaced image data, frame rate conversion unit 20 and image frame buffer 22 receive and store odd fields and even fields of image data 16 for image 12. For example, all of the odd fields of image data 16 are received and stored and all of the even fields of image data 16 are received and stored. As such, frame rate conversion unit 20 de-interlaces image data 16 and creates image frame 28 by retrieving the odd and even fields of image data 16 for image 12.

Image frame buffer 22 includes memory for storing image data 16 for one or more image frames 28 of respective images 12. Thus, image frame buffer 22 constitutes a database of one or more image frames 28. Examples of image frame buffer 22 include non-volatile memory (e.g., a hard disk drive or other persistent storage device) and may include volatile memory (e.g., random access memory (RAM)).

By receiving image data 16 at frame rate conversion unit 20 and buffering image data 16 with image frame buffer 22, input timing of image data 16 can be decoupled from a timing requirement of display device 26. More specifically, since image data 16 for image frame 28 is received and stored by image frame buffer 22, image data 16 can be received as input at any rate. As such, the frame rate of image frame 28 can be converted to the timing requirement of display device 26. Thus, image data 16 for image frame 28 can be extracted from image frame buffer 22 at a frame rate of display device 26.

In one embodiment, image processing unit 24 includes a resolution adjustment unit 34 and a sub-frame generation unit 36. As described below, resolution adjustment unit 34 receives image data 16 for image frame 28 and adjusts a resolution of image data 16 for display on display device 26, and sub-frame generation unit 36 generates a plurality of image sub-frames 30 for image frame 28. More specifically, image processing unit 24 receives image data 16 for image frame 28 at an original resolution and processes image data 16 to match the resolution of display device 26. For example, image processing unit 24 increases, decreases, and/or leaves unaltered the resolution of image data 16 so as to match the resolution of display device 26. Thus, by matching the resolution of image data 16 to the resolution of display device 26, display device 26 can display image data 16. Accordingly, with image processing unit 24, image display system 10 can receive and display image data 16 of varying resolutions.

In one embodiment, image processing unit 24 increases a resolution of image data 16. For example, image data 16 may be of a resolution less than that of display device 26. More specifically, image data 16 may include lower resolution data, such as 400 pixels by 300 pixels, and display device 26 may support higher resolution data, such as 800 pixels by 600 pixels. As such, image processing unit 24 processes image data 16 to increase the resolution of image data 16 to the resolution of display device 26. Image processing unit 24 may increase the resolution of image data 16 by, for example, pixel replication, interpolation, and/or any other resolution synthesis or generation technique.

In one embodiment, image processing unit 24 decreases a resolution of image data 16. For example, image data 16 may be of a resolution greater than that of display device 26. More specifically, image data 16 may include higher resolution data, such as 1600 pixels by 1200 pixels, and display device 26 may support lower resolution data, such as 800 pixels by 600 pixels. As such, image processing unit 24 processes image data 16 to decrease the resolution of image data 16 to the resolution of display device 26. Image processing unit 24 may decrease the resolution of image data 16 by, for example, sub-sampling, interpolation, and/or any other resolution reduction technique.

Sub-frame generation unit 36 receives and processes image data 16 for image frame 28 to define a plurality of image sub-frames 30 for image frame 28. If resolution adjustment unit 34 has adjusted the resolution of image data 16, sub-frame generation unit 36 receives image data 16 at the adjusted resolution. The adjusted resolution of image data 16 may be increased, decreased, or the same as the original resolution of image data 16 for image frame 28. Sub-frame generation unit 36 generates image sub-frames 30 with a resolution which matches the resolution of display device 26. Image sub-frames 30 are each of an area equal to image frame 28 and each include a plurality of columns and a plurality of rows of individual pixels representing a subset of image data 16 of image 12 and have a resolution which matches the resolution of display device 26.

Each image sub-frame 30 includes a matrix or array of pixels for image frame 28. Image sub-frames 30 are spatially offset from each other such that each image sub-frame 30 includes different pixels and/or portions of pixels. As such, image sub-frames 30 are offset from each other by a vertical distance and/or a horizontal distance, as described below.

Display device 26 receives image sub-frames 30 from image processing unit 24 and sequentially displays image sub-frames 30 to create displayed image 14. More specifically, as image sub-frames 30 are spatially offset from each other, display device 26 displays image sub-frames 30 in different positions according to the spatial offset of image sub-frames 30, as described below. As such, display device 26 alternates between displaying image sub-frames 30 for image frame 28 to create displayed image 14. Accordingly, display device 26 displays an entire sub-frame 30 for image frame 28 at one time.

In one embodiment, display device 26 completes one cycle of displaying image sub-frames 30 for image frame 28. Thus, display device 26 displays image sub-frames 30 so as to be spatially and temporally offset from each other. In one embodiment, display device 26 optically steers image sub-frames 30 to create displayed image 14. As such, individual pixels of display device 26 are addressed to multiple locations.

In one embodiment, display device 26 includes an image shifter 38. Image shifter 38 spatially alters or offsets the position of image sub-frames 30 as displayed by display device 26. More specifically, image shifter 38 varies the position of display of image sub-frames 30, as described below, to produce displayed image 14.

In one embodiment, display device 26 includes a light modulator for modulation of incident light. The light modulator includes, for example, a plurality of micro-mirror devices arranged to form an array of micro-mirror devices. As such, each micro-mirror device constitutes one cell or pixel of display device 26. Display device 26 may form part of a display, projector, or other imaging system.

In one embodiment, image display system 10 includes a timing generator 40. Timing generator 40 communicates, for example, with frame rate conversion unit 20, image processing unit 24, including resolution adjustment unit 34 and sub-frame generation unit 36, and display device 26, including image shifter 38. As such, timing generator 40 synchronizes buffering and conversion of image data 16 to create image frame 28, processing of image frame 28 to adjust the resolution of image data 16 to the resolution of display device 26 and generate image sub-frames 30, and display and positioning of image sub-frames 30 to produce displayed image 14. Accordingly, timing generator 40 controls timing of image display system 10 such that entire sub-frames of image 12 are temporally and spatially displayed by display device 26 as displayed image 14.

Figure 2C:
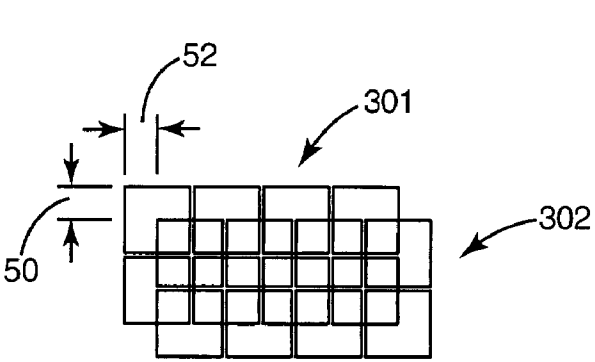
FIGS. 2A–2C are schematic illustrations of one embodiment of processing and displaying a frame of an image according to the present invention.
Figure 2B:
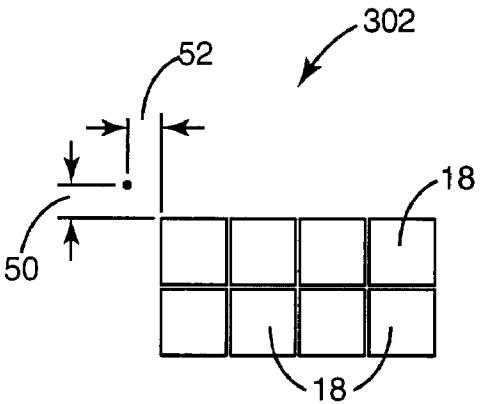
Figure 2A:
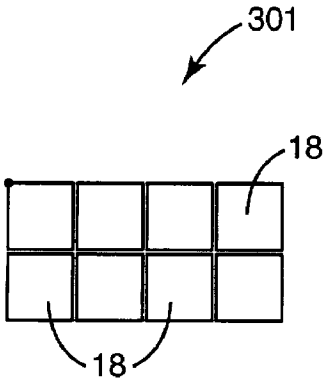

In one embodiment, as illustrated in FIGS. 2A and 2B, image processing unit 24 defines a plurality of image sub-frames 30 for image frame 28. More specifically, image processing unit 24 defines a first sub-frame 301 and a second sub-frame 302 for image frame 28. As such, first sub-frame 301 and second sub-frame 302 each include a plurality of columns and a plurality of rows of individual pixels 18 of image data 16. Thus, first sub-frame 301 and second sub-frame 302 each constitute an image data array or pixel matrix of a subset of image data 16.

In one embodiment, as illustrated in FIG. 2B, second sub-frame 302 is offset from first sub-frame 301 by a vertical distance 50 and a horizontal distance 52. As such, second sub-frame 302 is spatially offset from first sub-frame 301 by a predetermined distance. In one illustrative embodiment, vertical distance 50 and horizontal distance 52 are each approximately one-half of one pixel.

As illustrated in FIG. 2C, display device 26 alternates between displaying first sub-frame 301 in a first position and displaying second sub-frame 302 in a second position spatially offset from the first position. More specifically, display device 26 shifts display of second sub-frame 302 relative to display of first sub-frame 301 by vertical distance 50 and horizontal distance 52. As such, pixels of first sub-frame 301 overlap pixels of second sub-frame 302. In one embodiment, display device 26 completes one cycle of displaying first sub-frame 301 in the first position and displaying second sub-frame 302 in the second position for image frame 28. Thus, second sub-frame 302 is spatially and temporally displayed relative to first sub-frame 301.

Figure 3A:
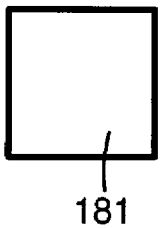
FIGS. 3A–3C are schematic illustrations of one embodiment of displaying a pixel with an image display system according to the present invention.
Figure 3B:
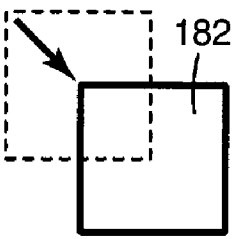
Figure 3C:
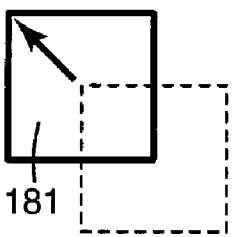

FIGS. 3A–3C illustrate one embodiment of completing one cycle of displaying a pixel 181 from first sub-frame 301 in the first position and displaying a pixel 182 from second sub-frame 302 in the second position. More specifically, FIG. 3A illustrates display of pixel 181 from first sub-frame 301 in the first position, FIG. 3B illustrates display of pixel 182 from second sub-frame 302 in the second position (with the first position being illustrated by dashed lines), and FIG. 3C illustrates display of pixel 181 from first sub-frame 301 in the first position (with the second position being illustrated by dashed lines).

Figure 5:
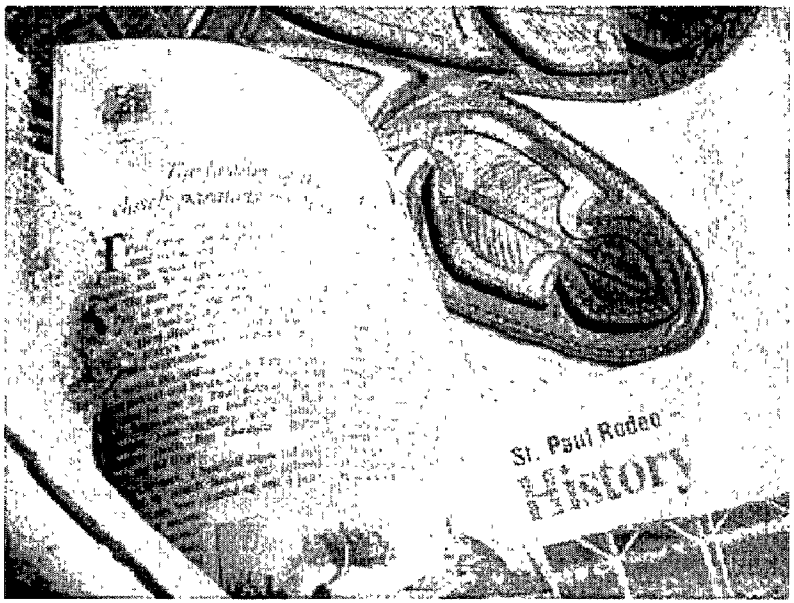
FIG. 5 is a simulation of one embodiment of an enlarged image portion produced with processing by an image display system according to the present invention.
Figure 4:
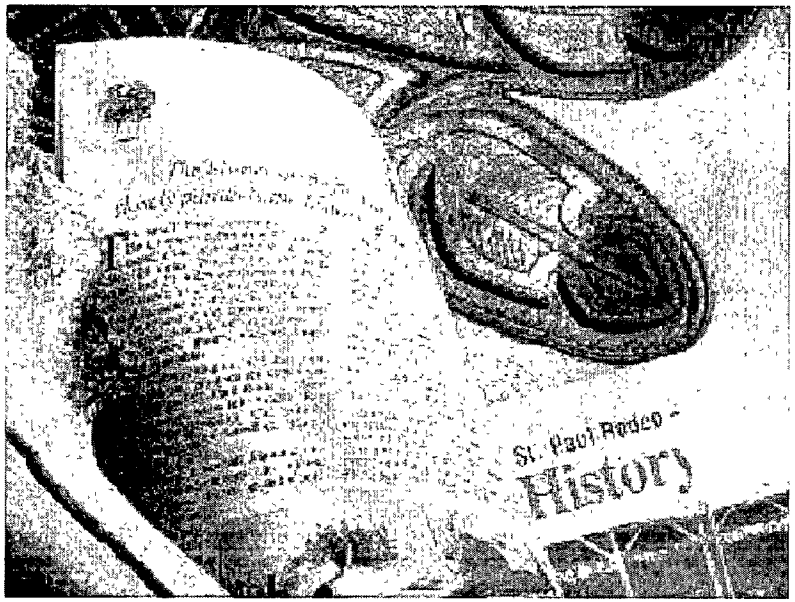
FIG. 4 is a simulation of one embodiment of an enlarged image portion produced without processing by an image display system according to the present invention.

FIGS. 4 and 5 illustrate enlarged image portions produced from the same image data without and with, respectively, image processing by image display system 10. More specifically, FIG. 4 illustrates an enlarged image portion 60 produced without processing by image display system 10. As illustrated in FIG. 4, enlarged image portion 60 appears pixelated with individual pixels being readily visible. In addition, enlarged image portion 60 is of a lower resolution.

FIG. 5, however, illustrates an enlarged image portion 62 produced with processing by image display system 10. As illustrated in FIG. 5, enlarged image portion 62 does not appear as pixelated as enlarged image portion 60 of FIG. 4. Thus, image quality of enlarged image portion 62 is enhanced with image display system 10. More specifically, resolution of enlarged image portion 62 is improved or increased compared to enlarged image portion 60.

In one illustrative embodiment, enlarged image portion 62 is produced by two-position processing including a first sub-frame and a second sub-frame, as described above. Thus, twice the amount of pixel data is used to create enlarged image portion 62 as compared to the amount of pixel data used to create enlarged image portion 60. Accordingly, with two-position processing, the resolution of enlarged image portion 62 is increased relative to the resolution of enlarged image portion 60 by a factor of approximately 1.4 or the square root of two.

In another embodiment, as illustrated in FIGS. 6A–6D, image processing unit 24 defines a plurality of image sub-frames 30 for image frame 28. More specifically, image processing unit 24 defines a first sub-frame 301, a second sub-frame 302, a third sub-frame 303, and a fourth sub-frame 304 for image frame 28. As such, first sub-frame 301, second sub-frame 302, third sub-frame 303, and fourth sub-frame 304 each include a plurality of columns and a plurality of rows of individual pixels 18 of image data 16.

Figure 6A:
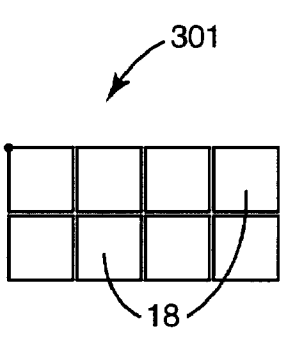
FIGS. 6A–6E are schematic illustrations of another embodiment of processing and displaying a frame of an image according to the present invention.
Figure 6B:
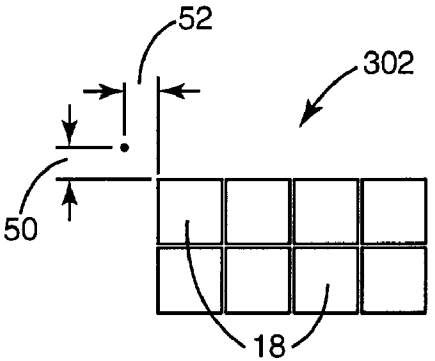
Figure 6C:
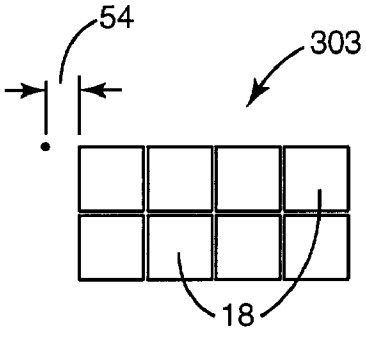
Figure 6D:
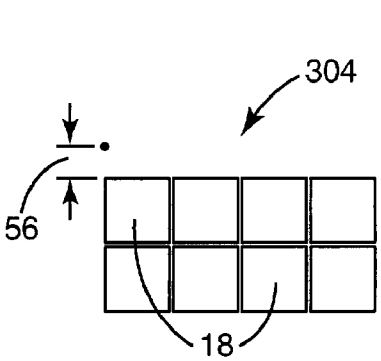

In one embodiment, as illustrated in FIGS. 6B–6D, second sub-frame 302 is offset from first sub-frame 301 by a vertical distance 50 and a horizontal distance 52, third sub-frame 303 is offset from first sub-frame 301 by a horizontal distance 54, and fourth sub-frame 304 is offset from first sub-frame 301 by a vertical distance 56. As such, second sub-frame 302, third sub-frame 303, and fourth sub-frame 304 are each spatially offset from each other and spatially offset from first sub-frame 301 by a predetermined distance. In one illustrative embodiment, vertical distance 50, horizontal distance 52, horizontal distance 54, and vertical distance 56 are each approximately one-half of one pixel.

Figure 6E:
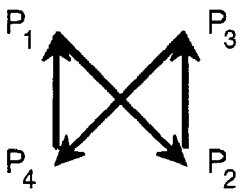

As illustrated schematically in FIG. 6E, display device 26 alternates between displaying first sub-frame 301 in a first position $P_1$, displaying second sub-frame 302 in a second position $P_2$ spatially offset from the first position, displaying third sub-frame 303 in a third position $P_3$ spatially offset from the first position, and displaying fourth sub-frame 304 in a fourth position $P_4$ spatially offset from the first position. More specifically, display device 26 shifts display of second sub-frame 302, third sub-frame 303, and fourth sub-frame 304 relative to first sub-frame 301 by the respective predetermined distance. As such, pixels of first sub-frame 301, second sub-frame 302, third sub-frame 303, and fourth sub-frame 304 overlap each other.

In one embodiment, display device 26 completes one cycle of displaying first sub-frame 301 in the first position, displaying second sub-frame 302 in the second position, displaying third sub-frame 303 in the third position, and displaying fourth sub-frame 304 in the fourth position for image frame 28. Thus, second sub-frame 302, third sub-frame 303, and fourth sub-frame 304 are spatially and temporally displayed relative to each other and relative to first sub-frame 301.

Figure 7A:
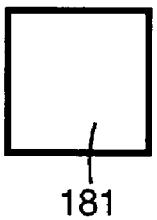
FIGS. 7A–7E are schematic illustrations of one embodiment of displaying a pixel with an image display system according to the present invention.
Figure 7B:
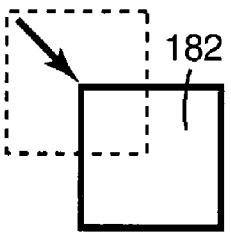
Figure 7C:
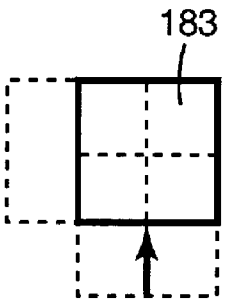
Figure 7D:
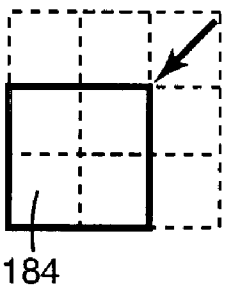
Figure 7E:
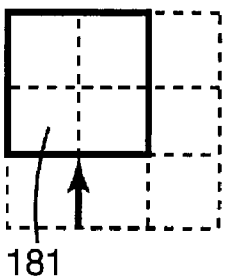

FIGS. 7A–7E illustrate one embodiment of completing one cycle of displaying a pixel 181 from first sub-frame 301 in the first position, displaying a pixel 182 from second sub-frame 302 in the second position, displaying a pixel 183 from third sub-frame 303 in the third position, and displaying a pixel 184 from fourth sub-frame 304 in the fourth position. More specifically, FIG. 7A illustrates display of pixel 181 from first sub-frame 301 in the first position, FIG. 7B illustrates display of pixel 182 from second sub-frame 302 in the second position (with the first position being illustrated by dashed lines), FIG. 7C illustrates display of pixel 183 from third sub-frame 303 in the third position (with the first position and the second position being illustrated by dashed lines), FIG. 7D illustrates display of pixel 184 from fourth sub-frame 304 in the fourth position (with the first position, the second position, and the third position being illustrated by dashed lines), and FIG. 7E illustrates display of pixel 181 from first sub-frame 301 in the first position (with the second position, the third position, and the fourth position being illustrated by dashed lines).

Figure 9:
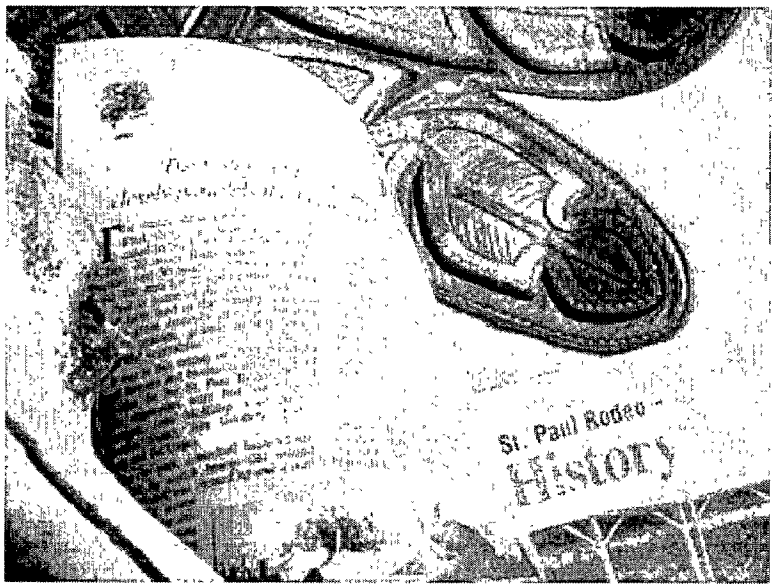
FIG. 9 is a simulation of another embodiment of an enlarged image portion produced with processing by an image display system according to the present invention.
Figure 8:
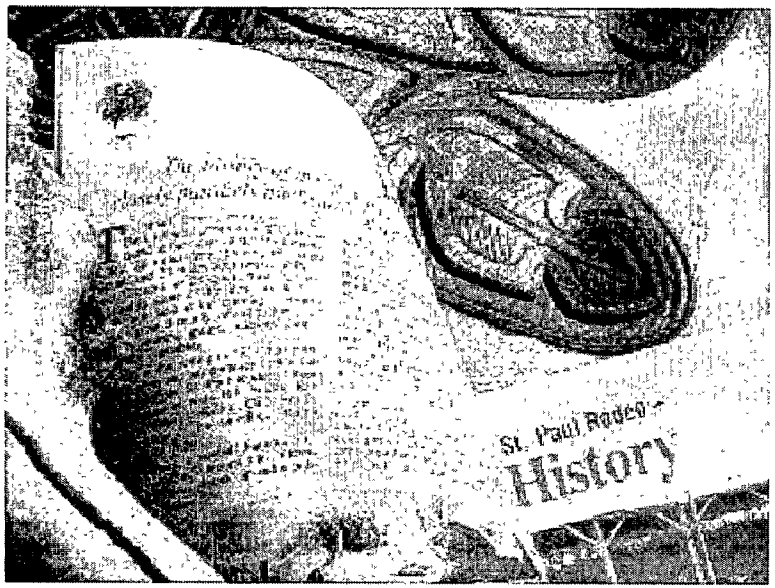
FIG. 8 is a simulation of another embodiment of an enlarged image portion produced without processing by an image display system according to the present invention.

FIGS. 8 and 9 illustrate enlarged image portions produced from the same image data without and with, respectively, image processing by image display system 10. More specifically, FIG. 8 illustrates an enlarged image portion 64 produced without processing by image display system 10. As illustrated in FIG. 8, areas of enlarged image portion 64 appear pixelated with individual pixels including, for example, pixels forming and/or outlining letters of enlarged image portion 64 being readily visible.

FIG. 9, however, illustrates an enlarged image portion 66 produced with processing by image display system 10. As illustrated in FIG. 9, enlarged image portion 66 does not appear pixelated compared to enlarged image portion 64 of FIG. 8. Thus, image quality of enlarged image portion 66 is enhanced with image display system 10. More specifically, resolution of enlarged image portion 66 is improved or increased compared to enlarged image portion 64.

In one illustrative embodiment, enlarged image portion 66 is produced by four-position processing including a first sub-frame, a second sub-frame, a third sub-frame, and a fourth sub-frame, as described above. Thus, four times the amount of pixel data is used to create enlarged image portion 66 as compared to the amount of pixel data used to create enlarged image portion 64. Accordingly, with four-position processing, the resolution of enlarged image portion 64 is increased relative to the resolution of enlarged image portion 64 by a factor of two or the square root of four. Four-position processing, therefore, allows image data 16 to be displayed at double the resolution of display device 26 since double the number of pixels in each axis (x and y) gives four times as many pixels.

By defining a plurality of image sub-frames 30 for image frame 28 and spatially and temporally displaying image sub-frames 30 relative to each other, image display system 10 can produce displayed image 14 with a resolution greater than that of display device 26. In one illustrative embodiment, for example, with image data 16 having a resolution of 800 pixels by 600 pixels and display device 26 having a resolution of 800 pixels by 600 pixels, four-position processing by image display system 10 with resolution adjustment of image data 16 produces displayed image 14 with a resolution of 1600 pixels by 1200 pixels. Accordingly, with lower resolution image data and a lower resolution display device, image display system 10 can produce a higher resolution displayed image. In another illustrative embodiment, for example, with image data 16 having a resolution of 1600 pixels by 1200 pixels and display device 26 having a resolution of 800 pixels by 600 pixels, four-position processing by image display system 10 without resolution adjustment of image data 16 produces displayed image 14 with a resolution of 1600 pixels by 1200 pixels. Accordingly, with higher resolution image data and a lower resolution display device, image display system 10 can produce a higher resolution displayed image. In addition, by overlapping pixels of image sub-frames 30 while spatially and temporally displaying image sub-frames 30 relative to each other, image display system 10 can reduce the "screen-door" effect caused, for example, by gaps between adjacent micromirror devices of a light modulator.

By buffering image data 16 to create image frame 28 and decouple a timing of image data 16 from a frame rate of display device 26 and displaying an entire sub-frame 30 for image frame 28 at once, image display system 10 can produce displayed image 14 with improved resolution over the entire image. In addition, with image data of a resolution equal to or greater than a resolution of display device 26, image display system 10 can produce displayed image 14 with an increased resolution greater than that of display device 26. To produce displayed image 14 with a resolution greater than that of display device 26, higher resolution data can be supplied to image display system 10 as original image data or synthesized by image display system 10 from the original image data. Alternatively, lower resolution data can be supplied to image display system 10 and used to produce displayed image 14 with a resolution greater than that of display device 26. Use of lower resolution data allows for sending of images at a lower data rate while still allowing for higher resolution display of the data. Thus, use of a lower data rate may enable lower speed data interfaces and result in potentially less EMI radiation.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

The invention claimed is:

1. A method of displaying an image, the method comprising:

receiving image data for the image;

buffering the image data for the image, including creating a frame of the image;

defining a first sub-frame and at least a second sub-frame for the frame of the image from the image data, the second sub-frame being spatially offset from the first sub-frame; and alternating between displaying the first sub-frame in a first position and displaying the second sub-frame in a second position spatially offset from the first position, wherein defining the second sub-frame further includes defining a third sub-frame and a fourth sub-frame for the frame of the image from the image data, the fourth sub-frame being spatially offset from the third sub-frame and the third sub-frame and the fourth sub-frame both being spatially offset from the first sub-frame and the second sub-frame, and wherein alternating between displaying the first sub-frame and displaying the second sub-frame further includes alternating between displaying the first sub-frame in the first position, displaying the second sub-frame in the second position, displaying the third sub-frame in a third position spatially offset from the first position and the second position, and displaying the fourth sub-frame in a fourth position spatially offset from the first position, the second position, and the third position.

2. The method of claim 1, wherein alternating between displaying the first sub-frame, displaying the second sub-frame, displaying the third sub-frame, and displaying the fourth sub-frame includes completing one cycle of displaying the first sub-frame, the second sub-frame, the third sub-frame, and the fourth sub-frame for the frame of the image.

3. A method of displaying an image, the method comprising:

receiving image data for the image;

buffering the image data for the image, including creating a frame of the image;

defining a first sub-frame and at least a second sub-frame for the frame of the image from the image data, the second sub-frame being spatially offset from the first sub-frame; and alternating between displaying the first sub-frame in a first position and displaying the second sub-frame in a second position spatially offset from the first position, wherein the second sub-frame is offset at least one of a vertical distance and a horizontal distance from the first sub-frame, and wherein alternating between displaying the first sub-frame and displaying the second sub-frame includes shifting display of the second sub-frame the at least one of the vertical distance and the horizontal distance from the first sub-frame.

4. The method of claim 3, wherein buffering the image data includes storing all of the image data for the frame of the image, and wherein creating the frame of the image includes retrieving all of the image data for the frame of the image.

5. The method of claim 3, wherein defining the first sub-frame and the second sub-frame includes adjusting a resolution of the image data.

6. The method of claim 5, wherein adjusting the resolution of the image data includes sub-sampling the image data and decreasing the resolution of the image data.

7. The method of claim 5, wherein adjusting the resolution of the image data includes interpolating the image data and one of increasing and decreasing the resolution of the image data.

8. The method of claim 3, wherein the image data includes individual pixels of the image, wherein the frame of the image includes a plurality of columns and a plurality of rows of the individual pixels of the image, and wherein defining the first sub-frame and the second sub-frame includes defining a first pixel matrix and at least a second pixel matrix for the frame of the image from the image data.

9. The method of claim 8, wherein alternating between displaying the first sub-frame and displaying the second sub-frame includes overlapping pixels of the first pixel matrix with pixels of the second pixel matrix.

10. The method of claim 3, wherein alternating between displaying the first sub-frame and displaying the second sub-frame includes displaying the image and effectively increasing a resolution of the image.

11. The method of claim 3, wherein alternating between displaying the first sub-frame and displaying the second sub-frame includes displaying the first sub-frame and displaying the second sub-frame with a display device, including effectively increasing a resolution of the display device.

12. The method of claim 11, wherein the image data is of a resolution greater than the resolution of the display device, and wherein defining the first sub-frame and the second sub-frame includes decreasing the resolution of the image data to the resolution of the display device.

13. The method of claim 11, wherein the image data is of a resolution less than the resolution of the display device, and wherein defining the first sub-frame and the second sub-frame includes increasing the resolution of the image data to the resolution of the display device.

14. The method of claim 3, wherein alternating between displaying the first sub-frame and displaying the second sub-frame includes completing one cycle of displaying the first sub-frame in the first position and displaying the second sub-frame in the second position for the frame of the image.

15. A method of displaying an image with a display device, the method comprising:

receiving image data for the image, the image data including individual pixels of the image;

buffering the image data and creating a frame of the image, the frame of the image including a plurality of columns and a plurality of rows of the pixels of the image;

separating the frame of the image into a first pixel matrix and at least one second pixel matrix spatially offset from the first pixel matrix; and displaying the first pixel matrix and the second pixel matrix with the display device, including spatially and temporally displaying the second pixel matrix relative to the first pixel matrix, wherein separating the frame of the image into the first pixel matrix and the second pixel matrix further includes separating the frame of the image into a third pixel matrix and a fourth pixel matrix spatially offset from the third pixel matrix, the third pixel matrix and the fourth pixel matrix both being spatially offset from the first pixel matrix and the second pixel matrix, and wherein displaying the first pixel matrix and the second pixel matrix further includes displaying the first pixel matrix, the second pixel matrix, the third pixel matrix, and the fourth pixel matrix with the display device, including spatially and temporally displaying the first pixel matrix, the second pixel matrix, the third pixel matrix, and the fourth pixel matrix relative to each other.

16. The method of claim 15, wherein spatially and temporally displaying the second pixel matrix relative to the first pixel matrix includes effectively increasing a resolution of the display device.

17. The method of claim 15, wherein spatially and temporally displaying the second pixel matrix relative to the first pixel matrix includes overlapping pixels of the first pixel matrix with pixels of the second pixel matrix.

18. The method of claim 15, wherein buffering the image data includes storing all of the image data for the frame of the image, and wherein creating the frame of the image includes retrieving all of the image data for the frame of the image.

19. The method of claim 15, further comprising:

matching a resolution of the image data to a resolution of the display device.

20. The method of claim 19, wherein matching the resolution of the image data to the resolution of the display device includes sub-sampling the image data and decreasing the resolution of the image data.

21. The method of claim 19, wherein matching the resolution of the image data to the resolution of the display device includes interpolating the image data and one of increasing and decreasing the resolution of the image data.

22. The method of claim 15, wherein displaying the first pixel matrix and the second pixel matrix includes completing one cycle of displaying the first pixel matrix and the second pixel matrix with the display device for the frame of the image.

23. The method of claim 15, wherein spatially and temporally displaying the second pixel matrix relative to the first pixel matrix includes effectively increasing a resolution of the image.

24. A system for displaying an image, the system comprising:

a buffer adapted to receive image data for the image and buffer the image data to create a frame of the image;

an image processing unit adapted to define a first sub-frame and at least a second sub-frame for the frame of the image from the image data, the second sub-frame being spatially offset from the first sub-frame; and a display device adapted to alternately display the first sub-frame in a first position and the second sub-frame in a second position spatially offset from the first position, wherein the second sub-frame is spatially offset at least one of a vertical distance and a horizontal distance from the first sub-frame, and wherein the display device is adapted to shift display of the second sub-frame from display of the first sub-frame by the at least one of the vertical distance and the horizontal distance.

25. The system of claim 24, wherein the display device is adapted to complete one cycle of display of the first sub-frame and display of the second sub-frame for the frame of the image.

26. The system of claim 24, wherein the display device is adapted to display the image and effectively increase a resolution of the image.

27. The system of claim 24, further comprising:

a frame rate conversion unit adapted to receive the image data for the image, store the image data in the buffer, and retrieve the image data from the buffer to create the image frame for the image.

28. The system of claim 27, wherein the frame rate conversion unit is adapted to receive the image data for the image at a first rate and retrieve the image data from the buffer at a second rate.

29. The system of claim 24, wherein the image processing unit is adapted to match a resolution of the image data to a resolution of the display device.

30. The system of claim 29, wherein the image processing unit is adapted to sub-sample the image data and decrease the resolution of the image data.

31. The system of claim 29, wherein the image processing unit is adapted to interpolate the image data and one of increase and decrease the resolution of the image data.

32. The system of claim 24, wherein the image data includes individual pixels of the image, wherein the frame of the image includes a plurality of columns and a plurality of rows of the individual pixels of the image, and wherein the image processing unit is adapted to define a first pixel matrix and at least a second pixel matrix of the image from the image data.

33. The system of claim 32, wherein the display device is adapted to overlap pixels of the first pixel matrix with pixels of the second pixel matrix.

* * * * *